US006390305B1

(12) United States Patent
Rabasco et al.

(10) Patent No.: US 6,390,305 B1
(45) Date of Patent: May 21, 2002

(54) SATURANT BINDER SYSTEMS FOR HIGH PERFORMANCE AIR AND OIL FILTERS

(75) Inventors: John Joseph Rabasco; Ronald Bernal Jones; William Edward Lenney; George Davidowich, all of Allentown, PA (US)

(73) Assignee: Air Products Polymers, L.P., Allentown, PA (US)

( * ) Notice: Subject to any disclaimer, the term of this patent is extended or adjusted under 35 U.S.C. 154(b) by 0 days.

(21) Appl. No.: 09/574,936

(22) Filed: May 19, 2000

(51) Int. Cl.[7] ..... B01D 71/38; B01D 39/00

(52) U.S. Cl. ..... 210/504; 210/503; 210/506; 427/244; 427/389.9; 428/355 EN

(58) Field of Search ..... 210/503, 504, 210/506; 427/385.5, 389.9, 399, 244; 428/324, 355 R, 355 EN; 524/503, 557

(56) References Cited

U.S. PATENT DOCUMENTS

| | | | | |
|---|---|---|---|---|
| 3,608,564 A | * | 9/1971 | Takahashi et al. | |
| 4,623,462 A | | 11/1986 | Urig et al. | 210/496 |
| 4,999,239 A | | 3/1991 | Iacoviello et al. | 428/288 |
| 5,244,695 A | | 9/1993 | Davidowich et al. | 427/389.9 |
| 5,354,803 A | | 10/1994 | Dragner et al. | 524/503 |
| 5,693,707 A | * | 12/1997 | Cheng et al. | 524/556 |

* cited by examiner

*Primary Examiner*—John Kim
(74) *Attorney, Agent, or Firm*—Mary E. Bongiorno

(57) ABSTRACT

High performance filters comprise a basestock impregnated with an aqueous based poly(vinyl alcohol) graft emulsion copolymer as binder. The aqueous based poly(vinyl alcohol) graft emulsion copolymer binder is prepared by graft polymerizing one or more ethylenically unsaturated monomer in an aqueous poly(vinyl alcohol) solution in which at least 30% of the total poly(vinyl alcohol) is 70 to 97 mol % hydrolyzed.

12 Claims, No Drawings

SATURANT BINDER SYSTEMS FOR HIGH PERFORMANCE AIR AND OIL FILTERS

BACKGROUND OF THE INVENTION

Emulsion or solution polymers are used to saturate paper substrates to impart tensile and stiffness properties, humidity resistance, and durability under high temperature conditions. Filter paper production is one of the major application areas in which paper saturation is utilized. Currently, two different polymer systems are typically used in the industry to saturate paper, depending upon whether the end use for the paper is an air filter or an oil filter. For air filters, water-based emulsion polymers, such as ethylene-co-vinyl chloride emulsions together with an external crosslinker, such as a melamine-formaldehyde resin, are typically used as paper saturants. Using these water-based emulsion polymers, an air filter paper is produced which displays adequate air permeability, wet tensile strength, and wet stiffness. However, with advances in technologies, such as heavy duty machinery, farm equipment, heavy duty trucks, and advanced internal combustion engine designs, demands have increased for improvement of water resistance, solvent and oil resistance, and high temperature stiffness of filter papers. In addition, environmental concerns impose other constraints and limitations on what is considered an acceptable binder system. For example, systems with high formaldehyde levels resulting from the use of melamine-formaldehyde crosslinkers can be problematic.

For higher performance filter papers such as hot oil filters, fuel filters and vacuum filters, solvent-based phenolic resin binders have commonly been used. However, there are disadvantages in using solvent-based phenolics, such as environmental concerns related to solvent VOC's, problems with handling residual phenol, and environmental concerns regarding residual formaldehyde. Due, in part, to the disadvantages associated with solvent-based resin binders, there is a desire in the industry to switch to all water-based binder systems which have comparable performance to the phenolic resins for high performance filter papers.

Some currently known water-based binder systems for filters are described below:

U.S. Pat. No. 4,623,462 (Urig et al., 1986) discloses oil filters containing water-based latex binders. A filter substrate is impregnated with a water-based binder comprising a latex containing at least 20% polymerized vinyl chloride. The latex is a copolymer of vinyl chloride, 30 to 60% lower alkyl acrylate, and up to 5% one or more comonomers selected from acrylic acid and N-methylol acrylamide, based on the weight of monomers used to make the latex; said binder also containing 5 to 20 parts of a crosslinking resin per 100 weight parts of latex solids and 5 to 20% catalyst for the crosslinking resin based on the weight of the crosslinking resin.

U.S. Pat. No. 4,999,239 (Iacoviello et al., 1991) discloses a binder composition, for application onto non bonded filter paper. The binder composition is an aqueous emulsion containing an ethylene-vinyl chloride copolymer and tetramethylol glycoluril and are prepared by incorporating 4 to 10 wt % tetramethylol glycoluril, based on the total weight of the emulsion copolymer, into an aqueous dispersion of a copolymer consisting essentially of 65 to 90 wt % vinyl chloride, 5 to 35 wt % ethylene and optionally, up to 10 wt % of a hydroxyalkyl- or carboxylic acid-containing functional comonomer. The polymerization is conducted in the presence of a poly(vinyl alcohol) stabilizing system. Filter paper, formed by impregnating paper or other suitable substrate with the copolymer emulsion, is reported to show enhanced resistance to hot oil.

U.S. Pat. No. 5,244,695 (Davidovich et al., 1993) discloses a method for making a nonwoven filter in which a nonwoven filter substrate is impregnated with a curable binder composition, consisting essentially of 10 to 100 wt % a poly(vinyl alcohol) which is at least 98 mol % hydrolyzed and has a DPn of 100 to 2300; and 0 to 90 wt % of an aqueous polymer emulsion. The aqueous polymer emulsion is an ethylene-vinyl chloride copolymer emulsion or a vinyl acetate/N-methylolacrylamide copolymer emulsion, or both.

U.S. Pat. No. 5,354,803 (Dragner et al., 1994) discloses a poly(vinyl alcohol) graft copolymer binder emulsion for nonwoven products. The binder emulsion comprises 12 to 35% of a fully hydrolyzed low or ultra low molecular weight poly(vinyl alcohol) (at least 75% of the poly(vinyl alcohol) is at least 98 mol % hydrolyzed) and 65 to 88% of a vinyl and/or acrylic monomer which is graft copolymerized with the poly(vinyl alcohol). Examples of suitable vinyl and acrylic monomers include C1 to C8 acrylate and methacrylate esters, vinyl acetate, styrene, acrylic acid, and methacrylic acid.

BRIEF SUMMARY OF THE INVENTION

This invention is directed to high performance filters which are formed from a substrate or basestock, such as a nonwoven or a cellulosic material, impregnated with an aqueous based poly(vinyl alcohol) graft emulsion copolymer as binder.

The aqueous based poly(vinyl alcohol) graft emulsion copolymers are prepared by graft polymerizing poly(vinyl alcohol) with one or more ethylenically unsaturated monomer, and optionally, a crosslinking monomer, in an aqueous medium, in which 30 to 100% of the total poly (vinyl alcohol) is 70 to 97 mol % hydrolyzed.

The aqueous based graft emulsion copolymer of this invention can be combined with a crosslinking agent and/or catalyst and applied to a filter basestock, such as filter paper. The treated basestock can then dried at an elevated temperature to produce a filter media which is suitable for a variety of high performance applications, such as air filters, hot oil filters, and vacuum filters.

There are several advantages in using the above described poly(vinyl alcohol) graft emulsion copolymers as binders to produce high performance filters. For example:

- no solvent VOC's or residual formaldehyde are released into the environment during the production of the aqueous graft emulsion copolymer;
- only a single curing cycle is required after the graft emulsion copolymer is applied to the filter basestock;
- the treated basestock exhibits an excellent balance of stiffness, tensile, and air permeability; and
- the treated basestock can be used in a wide range of filter grades, especially high performance filters, such as air, hot oil, fuel, and vacuum filters.

DETAILED DESCRIPTION OF THE INVENTION

The aqueous grafted copolymer emulsions of this invention can be prepared by free radical initiated polymerization of one or more ethylenically unsaturated monomer in an aqueous solution of poly(vinyl alcohol).

Poly(vinyl alcohol) is derived from vinyl acetate polymers. The vinyl acetate polymers are formed by polymerizing vinyl acetate as a homopolymer or in conjunction with other monomers to form copolymers and are then hydrolyzed to form poly(vinyl alcohol) or vinyl alcohol copolymers. The mol percent of vinyl alcohol in the poly(vinyl alcohol) or vinyl alcohol copolymers should be sufficient to enable free radical graft polymerization in an aqueous solution; i.e., render the polymer at least partially soluble in an aqueous medium.

The poly(vinyl alcohol) used in this invention, generally, has a weight average molecular weight ($M_W$) ranging from about 5,000 to 150,000, preferably 10,000 to 120,000. Alternatively, the poly(vinyl alcohol) can have a degree of polymerization (Dp) of from 100 to 3,000, preferably 100 to 2000. Poly(vinyl alcohol) is made commercially by the hydrolysis of poly(vinyl acetate) and typically has a hydrolysis level ranging from about 85 to greater than 99 mol %. For this invention, the level of hydrolysis can range from 70 to greater than 99 mol %, preferably 85 to 99 mol %, provided that at least 30% of the total poly(vinyl alcohol) used in the grafting reaction is 70 to 97 mol % hydrolyzed, preferably 85 to 95 mol % hydrolyzed. Mixed poly(vinyl alcohol) grades, from combinations of poly(vinyl alcohol) polymers which vary in molecular weight and hydrolysis level, can be employed in the present invention.

Suitable monomers which can be employed for graft copolymerization onto poly(vinyl alcohol) to prepare the poly(vinyl alcohol) graft copolymer emulsion include, but are not limited to, vinyl acetate, styrene, vinyl chloride, $C_1$ to $C_{,12}$ alkyl acrylates and $C_1$ to $C_{12}$ alkyl methacrylates, such as ethyl methacrylate, methyl methacrylate, 2-ethylhexyl acrylate, butyl acrylate, propyl acrylate, ethyl acrylate, methyl acrylate, hydroxyethyl acrylate, hydroxypropyl acrylate, and mixtures thereof. Preferred monomers are vinyl acetate, styrene, vinyl chloride, and mixtures thereof.

Other monomers, such as crosslinking monomers, which may be present include, acrylamide, methacrylamide, N-methylolacrylamide, acetoacetoxyethyl methacrylate, maleic acid, and alkyl and dialkyl maleate estersi wherein alkyl is $C_1$ to $C_{12}$.

The free radical graft copolymerization reactions can be conducted in aqueous media at a temperature necessary to liberate free radicals for the graft polymerization. Typical temperatures range from 50 to 95° C., preferably 60 and 90° C.

Total reaction solids levels can vary from 20 to 60 wt %, depending on the molecular weight of the poly(vinyl alcohol), preferably from 30 to 55 wt %.

Reaction times typically range from 1 to 10 hours. The graft copolymerization reaction is preferably conducted in a manner in which the total free monomer concentration in the reaction mixture is minimized to enhance its graft polymerization with poly(vinyl alcohol) instead of simple homopolymerization with itself. Total free monomer concentrations can be less than 5%, preferably less than 2%.

Example of free radical initiators which can be employed in this graft copolymerization reaction include ammonium persulfate, sodium persulfate, potassium persulfate, tert-butylhydroperoxide, hydrogen peroxide and other good hydrogen atom abstracters. Persulfate initiator systems are preferred. Approximately 0.1 to 10 wt % (preferably 0.5 to 3 wt %) of the initiator, based on the amount of total monomer is used.

Weight percent levels of total ethylenically unsaturated monomer relative to poly(vinyl alcohol) typically range from 10 to 90 wt %, preferably from 50 to 90 wt %. Weight percent levels of a crosslinking monomer can range from 0 to 10 wt %; preferably 2 to 6 wt % relative to poly(vinyl alcohol).

The aqueous poly(vinyl alcohol) graft copolymer emulsion binder of this invention can be applied to a variety of filter basestocks or substrates, such as nonwovens, fabric, and cellulosic materials. Filter paper is especially suitable as a substrate; for example, bleached or unbleached filter paper weighing 30 to 180 g/m$^2$.

The binder can be applied to the basestock or substrate in an suitable fashion such as by spraying, dipping, roll transferring, or the like. Application is typically made at room temperature. The solids concentration of the binder is in the range of 10 to 60 wt %, perferably 10 to 35 wt % when applied by dipping. When applied by roll transfer, solids concentration of the binder is generally about 25 wt % whereas, with spraying the solids concentration can vary widely. The amount of binder, on a dry basis, typically ranges from 3 to 50 wt % of the filter substrate.

The impregnated substrate can then be dried and cured by passing it through an air oven or the like. Various time-temperature relationships can be employed for drying and curing as is well known in the art. For example 5 to 10 minutes at 150 to 200° F. (66–93° C.) for drying and 3 to 5 minutes at 250 to 350° F. (121 to 177° C.) for curing.

In making a high performance filter paper, the aqueous poly(vinyl alcohol) graft copolymer emulsion binder composition of the present invention can be applied to basepaper by immersing the basepaper in the binder to saturate the paper. After passing the paper through rollers to meter the coat weight, the paper can be dried in an oven at high temperature; for example, 300° F. (149° C.), for about 8 minutes for a single stage cure. The amount of graft copolymer emulsion (solids basis) added to the basepaper can be 10 to 35 wt %; preferably 20 to 30 wt %.

It is preferred to admix an external crosslinking agent and/or catalyst to the aqueous emulsion binder prior to saturating the paper to promote polymer crosslinking. Suitable crosslinking agents include, glyoxal, glutaraldehyde, and other dialdehydes, colloidal silica, melamine-formaldehyde resins, urea-formaldehyde, zirconium ammonium carbonates, polyamide-epichlorohydrin resins, emulsified epoxy resins, phenol-formaldehyde resins, and polyacrylate resins containing pendant unsaturation and other crosslinking resins. The amount of external crosslinking agent is typically about 1 to 20 wt %; preferably, about 5 to 15 wt %.

Suitable catalysts include ammonium chloride, sodium bisulfate, and other acids to lower the pH of the binder saturant. The amount of catalyst is typically about 1 wt %; however the amount can range from 0.5 to 6 wt %.

The following table (Table 1) sets forth operative and preferred ranges regarding the synthesis and use of poly (vinyl alcohol) graft copolymer emulsions described in this invention.

TABLE 1

| | Operative Range | Preferred Range |
|---|---|---|
| Weight average molecular weight of PVOH | 5,000–150,000 | 10,000–120,000 |
| Degree of Polymerization of PVOH | 100–3,000 | 100–2000 |
| Hydrolysis level (mol %) of 30 | 70–97 | 85–95 |

TABLE 1-continued

| | Operative Range | Preferred Range |
|---|---|---|
| to 100% of the total PVOH | | |
| Hydrolysis level (mol %) of 0 to 29% of the total PVOH | 70–100 | 85–99 |
| Total Monomer Relative to PVOH (wt %) | 10–90 | 50–90 |
| Total Reaction Solids (wt %) | 20–60 | 30–55 |
| Initiator/Monomer Ratio (wt %) | 0.1–10 | 0.5–3 |
| Wt % Polymer Add-on to impregnated Filter Paper | 10–35 | 20–30 |

PVOH = poly(vinyl alcohol)

The invention will be further clarified by a consideration of the following examples, which are intended to be purely exemplary of the invention.

EXAMPLE 1

Poly(Vinyl Alcohol)-g-Polystyrene Graft Copolymer Using Partially Hydrolyzed, Ultra Low Molecular Weight Poly(Vinyl Alcohol)

A 20.0% aqueous solution of Airvol® 502 (560 grams, DPn~200, 88% hydrolyzed) poly(vinyl alcohol) and 700 g of water were charged to a 2-liter glass reactor equipped with an overhead stirrer, reflux condenser, nitrogen inlet, and circulating water bath. The reactor was purged with nitrogen for 15 minutes while heating to 90° C. with stirring at 200 rpm. Styrene (50 grams) was added to the reaction mixture, and after stirring for 5 minutes, catalyst solution (15 grams) was added in one portion. At initiation, delay feeds of styrene (398 grams @ 2.4 ml/minute feed rate) and catalyst solution (140 grams @ 0.70 ml/minute feed rate) were started. The catalyst solution consisted of sodium persulfate (4.0 grams), sodium bicarbonate (1.9 grams), and water (150 grams). The stirring speed was increased to 500 rpm during the reaction period. After completion of the catalyst solution delay feed, the reaction mixture was stirred for 30 minutes at 90° C. The resulting poly(styrene)-graft-poly(vinyl alcohol) graft copolymer emulsion had a total solids of 30.1%, a $T_g$=107° C., less than 0.5% accelerated sedimentation, and a Brookrield viscosity (20 rpm, 25° C.)=3420 centipoise.

EXAMPLE 2

Poly(Vinyl Acetate)-Co-Poly(Acrylamide)-Co-Poly (N-Methylolacrylamide) -Graft-Poly(Vinyl Alcohol) Graft Copolymer Using Partially Hydrolyzed, Medium Molecular Weight Poly(Vinyl Alcohol)

A 15% aqueous solution of Airvol® 523 (1260 grams, DPn~1200, 88% hydrolyzed) poly(vinyl alcohol) was charged to a 2-liter glass reactor equipped with an overhead stirrer, reflux condenser, nitrogen inlet, and circulating water bath. The reactor was purged with nitrogen for 15 minutes while heating to 65° C. with stirring at 200 rpm. Vinyl acetate (32 grams) and 5.0 grams of MAMD Special (a 17.5% aqueous blend containing 1:1 acrylamide and N-methylolacrylamide) was then added to the reaction mixture, and after stirring for 5 minutes, catalyst solution (10 grams) was added in one portion. The catalyst solution consisted of sodium persulfate (3.6 grams), sodium bicarbonate (2.0 grams), and water (100 grams). At initiation, delay feeds of vinyl acetate (292 grams @ 1.5 ml/minute feed rate), MAMD Special (149 grams @ 0.70 ml/minute), and catalyst solution (95 grams @ 0.45 ml/minute feed rate) were started. The stirring speed was increased to 500 rpm during the reaction period. After completion of the catalyst solution delay feed, the reaction mixture was stirred for 30 minutes at 65° C. The resulting poly(vinyl acetate)-co-poly (acrylamide)-co-poly(N-methylolacrylamide)-graft-poly (vinyl alcohol) graft copolymer emulsion had a total solids of 29.4%, a $T_g$=48.4° C., and a Brookfield viscosity (20 rpm, 25° C.)=20,450 centipoise.

EXAMPLE 3

Poly(Vinyl Acetate)-Graft-Poly(Vinyl Alcohol) Graft Copolymer Using Partially Hydrolyzed, Medium Molecular Weight Poly(Vinyl Alcohol)

A 14.5% aqueous solution of Airvol® 523 (497 grams, DP~1200, 88% hydrolyzed) and water (800 grams) was charged to a 2-liter glass reactor equipped with an overhead stirrer, reflux condenser, nitrogen inlet, and circulating water bath. The reactor was purged with nitrogen for 15 minutes while heating to 65° C. with stirring at 200 rpm. Vinyl acetate (30 grams) was then added to the reaction mixture, and after stirring for 5 minutes, catalyst solution (31 grams) was added in one portion. The catalyst solution consisted of sodium persulfate (2.9 grams), sodium bicarbonate (1.4 grams), and water (200 grams). At initiation, delay feeds of vinyl acetate (258 grams @ 1.8 ml/minute feed rate) and catalyst solution (173 grams @ 1.0 ml/minute feed rate) were started. The stirring speed was increased to 500 rpm during the reaction period. After completion of the catalyst solution delay feed, the reaction mixture was stirred for 30 minutes at 65° C. The resulting poly(vinyl acetate)-graft-poly(vinyl alcohol) graft copolymer emulsion had a total solids of 20.3%, a $T_g$=45.1° C., less than 0.5% accelerated sedimentation, and a Brookfield viscosity (20 rpm, 25° C.)=1540 centipoise.

EXAMPLE 4

Poly(Vinyl Acetate)-Graft-Poly(Vinyl Alcohol) Graft Copolymer Using Partially Hydrolyzed, Medium Molecular Weight Poly(Vinyl Alcohol)

A 14.5% aqueous solution of Airvol® 523 (994 grams, DP~1200, 88% hydrolyzed) and water (282 grams) was charged to a 2-liter glass reactor equipped with an overhead stirrer, reflux condenser, nitrogen inlet, and circulating water bath. The reactor was purged with nitrogen for 15 minutes while heating to 65° C. with stirring at 200 rpm. Vinyl acetate (25 grams) was then added to the reaction mixture, and after stirring for 5 minutes, catalyst solution (30 grams) was added in one portion. At initiation, delay feeds of vinyl acetate (191 grams @ 1.7 ml/minute feed rate) and catalyst solution (193 grams @ 1.3 ml/minute feed rate) were started. The catalyst solution consisted of sodium persulfate (2.2 grams), sodium bicarbonate (1.2 grams), and water (200 grams). The stirring speed was increased to 600 rpm during the reaction period. After completion of the catalyst solution delay feed, the reaction mixture was stirred for 30 minutes at 65° C. The resulting poly(vinyl acetate)-graft-poly(vinyl alcohol) graft copolymer emulsion had a total solids of 21.4%, a $T_g$=40.20° C., no detectable accelerated sedimentation, and a Brookfield viscosity (20 rpm, 25° C.)=8320 centipoise.

EXAMPLE 5

Poly(Vinyl Chloride)-Graft-Poly(Vinyl Alcohol) Graft Copolymer Using Partially Hydrolyzed, Low Molecular Weight Poly(Vinyl Alcohol)

A 21.0% aqueous solution of Airvol® 205 (833 grams, DP~500, 88% hydrolyzed) poly(vinyl alcohol) and water (1771 grams) was charged to a one-gallon high pressure reactor. After purging the system with nitrogen, vinyl chloride (70 grams) was added to the reactor and the resulting mixture was heated to 50° C. with stirring at 500 rpm. Once at temperature, 30 grams of a catalyst solution (15 grams of sodium persulfate, 5 grams of sodium bicarbonate, and 280 grams of water) was pumped into the reactor over a 3 minute period. After a 20 minute period, delay feeds of vinyl chloride (630 grams @ 2.6 grams/minute) and catalyst solution (166 grams @ 0.62 grams/minute) were started. After completion of the catalyst solution delay feed, the reaction mixture was maintained at temperature and stirred for 1 hour. The resulting poly(vinyl chloride)-graft-poly (vinyl alcohol) graft copolymer emulsion had 24.3% solids, pH=3.49, $T_g$=77° C., and a Brookfield viscosity (20 rpm, 25° C.)=1480 centipoise.

Comparative Example 6

Preparation of Poly(Vinly Alcohol)-g-Polystyrene Copolymer Using Fully Hydrolyzed, Ultra Low Molecular Weight Poly(Vinyl Alcohol)

A 19.1% aqueous solution of Airvol® 103 (587 grams, DP~200, 98.5% hydrolyzed) poly(vinyl alcohol) and water (689 grams) was charged to a 2-liter glass reactor equipped with an overhead stirrer, reflux condenser, nitrogen inlet, and circulating water bath. The reactor was purged with nitrogen for 15 minutes while heating to 90° C. with stirring at 200 rpm. Styrene (50 grams) was then added to the reaction mixture, and after stirring for 5 minutes, 10 g of the catalysts solution, consisted of sodium persulfate (3.5 grams), sodium bicarbonate (1.7 grams), and water (150 grams), was added in one portion. At initiation, delay feeds of styrene (398 grams @ 2.0 ml/minute feed rate) and catalyst solution (145 grams @ 0.60 ml/minute feed rate) were started. The stirring speed was increased to 500 rpm during the reaction period. After completion of the catalyst solution delay feed, the reaction mixture was stirred for 30 minutes at 90° C. The resulting poly(styrene)-graft-poly(vinyl alcohol) graft copolymer emulsion had a total solids of 29.5%, a $T_g$=108° C., less than 0.5% accelerated sedimentation, and a Brookfield viscosity (20 rpm, 25° C.)=200 centipoise.

Comparative Example 7

Preparation of Poly(Vinyl Alcohol)-g-Polystyrene Copolymer Using Fully Hydrolyzed, Ultra Low Molecular Weight Poly(Vinyl Alcohol)

A 19.2% aqueous solution of Airvol® 103 (503 grams, DP~200, 98.5% hydrolyzed) and water (346 grams) was charged to a 2-liter glass reactor equipped with an overhead stirrer, reflux condenser, nitrogen inlet, and circulating water bath. The reactor was purged with nitrogen for 15 minutes while heating to 90° C. with stirring at 200 rpm. Styrene (55 grams) was then added to the reaction mixture, and after stirring for 5 minutes, catalyst solution (25 grams) was added in one portion. The catalyst solution consisted of sodium persulfate (4.5 grams), sodium bicarbonate (1.6 grams), and water (200 grams). At initiation, delay feeds of styrene (489 grams @ 3.0 ml/minute feed rate) and catalyst solution (181 grams @ 0.90 ml/minute feed rate) were started. The stirring speed was increased to 500 rpm during the reaction period. After completion of the catalyst solution delay feed, the reaction mixture was stirred for 30 minutes at 90° C. The resulting poly(styrene)-graft-poly(vinyl alcohol) graft copolymer emulsion had a total solids of 39.3%, a $T_g$=112° C., 1.0% accelerated sedimentation, and a Brookfield viscosity (20 rpm, 25° C.)=1110 centipoise.

Comparative Example 8

Preparation of Poly(Vinyl Alcohol)-g-Poly(Vinyl Acetate) Using Fully Hydrolyzed, Ultra Low Molecualr Weight Poly(Vinyl Alcohol)

A 19.1% aqueous solution of Airvol® 103 (419 grams, DP~200, 98.5% hydrolyzed) and water (755 grams) was charged to a 2-liter glass reactor equipped with an overhead stirrer, reflux condenser, nitrogen inlet, and circulating water bath. The reactor was purged with nitrogen for 15 minutes while heating to 65° C. with stirring at 200 rpm. Vinyl acetate (30 grams) was then added to the reaction mixture, and after stirring for 5 minutes, a catalyst solution (10 grams) was added in one portion. The catalyst solution consisted of sodium persulfate (3.0 grams), sodium bicarbonate (1.0 grams), and water (100 grams). At initiation, delay feeds of vinyl acetate (290 grams @ 0.5 ml/minute feed rate) and catalyst solution (94 grams @ 0.57 ml/minute feed rate) were started. The stirring speed was increased to 500 rpm during the reaction period. After completion of the catalyst solution delay feed, the reaction mixture was stirred for 30 minutes at 65° C. The resulting poly(vinyl acetate)-graft-poly(vinyl alcohol) graft copolymer emulsion had a total solids of 24.7%, a $T_g$=43.6° C., less than 0.5% accelerated sedimentation, and a Brookfield viscosity (100 rpm, 25° C.)=45 centipoise.

Table 2 presents a summary the reactants and products of Examples 1–8.

TABLE 2

| | PVOH | | | | | Product | | |
|---|---|---|---|---|---|---|---|---|
| Ex | Tradename, mol % hydrolyzed | ~DPn | Amt, g | Monomer | Rx Type | % Solids | Viscosity 20 rpm, 25° ., cP | Tg ° C. |
| 1 | V502, 88 | 200 | 560 | Styrene, 50 g | thermal, 90° C. | 30.1 | 3420 | 107 |
| 2 | V523, 88 | 1200 | 1260 | 32 g VAc, 5 g MAMD* | thermal, 65° C. | 29.4 | 20,450 | 48.4 |
| 3 | V523, 88 | 1200 | 497 | VAc, 30 g | thermal, 65° C. | 20.3 | 1540 | 45.1 |
| 4 | V523, 88 | 1200 | 994 | VAc, 25 g | thermal, 65° C. | 21.4 | 8320 | 40.2 |

TABLE 2-continued

| | PVOH | | | | | Product | | |
|---|---|---|---|---|---|---|---|---|
| Ex | Tradename, mol % hydrolyzed | ~DPn | Amt, g | Monomer | Rx Type | % Solids | Viscosity 20 rpm, 25° ., cP | Tg ° C. |
| 5 | V205, 88 | 500 | 833 | VCl, 70 g | thermal, 50° C. | 24.3 | 1480 | 77 |
| Comp. 6 | V103, 98.5 | 200 | 587 | Styrene, 50 g | thermal, 90° C. | 29.5 | 200 | 108 |
| Comp. 7 | V103, 98.5 | 200 | 503 | Styrene, 55 g | thermal, 90° C. | 39.3 | 1110 | 112 |
| Comp. 8 | V103, 98.5 | 200 | 419 | VAc, 30 g | thermal, 65° C. | 24.7 | 45** | 43.6 |

***100 rpm; 25° C.
V103 = Airvol ® poly(vinyl alcohol) (DPn ~200; 98.5 mol % hydrolyzed)
V205 = Airvol ® poly(vinyl alcohol) (DPn ~500; 88 mol % hydrolyzed)
V502 = Airvol ® poly(vinyl alcohol) (DPn ~200; 88 mol % hydrolyzed)
V523 = Airvol ® poly(vinyl alcohol) (DPn ~1200; 88 mol % hydrolyzed)
MAMD = 1:1 mixture of acrylamide and N-methylolacrylamide
VAc = Vinyl acetate
VCl = Vinyl chloride The products of Examples 1 through 5 were unexpectedly much cleaner, i.e., had little or no grit, compared to the products of comparative examples 6 through 8. Contrary to the teachings of the prior art, stable graft emulsion copolymers were obtained in which at least 30% partially hydrolyzed poly(vinyl alcohol) was part of the total pol(vinyl alcohol) used.

EXAMPLE 9

Filter Paper Preparation

Unsaturated filter basestock (basis weight 125# /3000 sq ft) was used for the evaluation. Candidate graft copolymers were prepared for saturation by mixing with various additives (i.e. crosslinkers, catalysts, etc.) and adjusting formulation solids to 8–10% with water. Mixing was accomplished with a laboratory lightening mixer.

Basepaper was saturated with the formula to be evaluated and the excess was metered with an Atlas padder. Addition levels of 25–30 wt % polymer on cellulose fiber weight were targeted. The sheets were dried in a 300° F. oven for 7 to 9 minutes.

Tensile measurements were performed with on an Instron Model 1122. Air permeability measurements were accomplished using a Frazier air permeability tester (Model # 40GD10WM). Stiffness measurements were performed with a Teledyne Gurley stiffness tester (Model # 4171-D).

The wet tensile and wet stiffness test was performed with filter paper samples which were immersed in water containing 1% aerosol OT for 30 seconds. After immersion, the samples were removed, blotted with paper towels to remove the excess water, and tested immediately. Hot oil stiffness measurements were performed with filter paper samples which were immersed in motor oil (Valvoline SAE 30, non-detergent) which was preheated to 250° F. Immersion time was 30 seconds. After immersion, the samples were removed and the excess oil was blotted from the sample with paper towels. Samples were then immediately tested for stiffness using a Gurley tensiometer.

Table 3 provides data on the performance of several filter paper samples prepared with a traditional binder (sample 2), with binders in which the poly(vinyl alcohol) in the graft emulsion copolymer is fully hydrolyzed (samples 3–5), and with examples of poly(vinyl alcohol) graft copolymer emulsion binders of this invention (samples 6–14). Other oil filter paper evaluations have shown that sample 8 had four times the hot oil tensile strength compared to the control sample 2 after the filter papers were stored in 140° C. oil for 3 weeks. Furthermore, sample 8 matched the performance of a solvent based phenolic binder under this long term hot oil storage test.

TABLE 3

| | Sample # | | | | | | | |
|---|---|---|---|---|---|---|---|---|
| | 1 | 2 | 3 | 4 | 5 | 6 | 7 | 8 |
| | Base paper | A4530 (control) | 80% VAM/ 20% V103 | 80% Styrene/ 20% V103 | 85% Styrene/ 15% V103 | 60% VAM/ 40% V523 | 80% VAM/ 20% V523 | 60% VAM/ 35% V523/ 5% MAMD |
| Post-added Crosslinker | — | 15% Resimene | 10% Glyoxal | 10% Glyoxal | 10% Glyoxal | 10% Glyoxal | 10% Glyoxal | 10% Glyoxal |
| Air Permeability $Ft^3$/sq. ft./min | 50.3 | 39.6 | 44.7 | 34.0 | 33.0 | 40.0 | 40.8 | 40.4 |
| Tensile (pli) | | | | | | | | |
| Dry | 8.7 | 29.7 | 20.8 | 27.4 | 26.5 | 40.6 | 32.7 | 33.5 |

TABLE 3-continued

| | | | | | | | | |
|---|---|---|---|---|---|---|---|---|
| Wet Stiffness (mg/in) | 2.5 | 19.0 | 7.9 | 12.2 | 14.0 | 10.6 | 12.8 | 17.6 |
| Dry | 799 | 3667 | 3578 | 4767 | 4390 | 3934 | 3823 | 4245 |
| Wet | 149 | 1476 | 644 | 1499 | 1499 | 358 | 397 | 543 |
| 250° F. | 652 | 1245 | 1689 | 3667 | 4334 | 1934 | 1934 | 2456 |

| | Sample # | | | | | |
|---|---|---|---|---|---|---|
| | 9 | 10 | 11 | 12 | 13 | 14 |
| | 60% VAM/ 35% V523/ 5% AAEM | 80% VCl/ 20% V205 | 80% Styrene/ 20% V502 | 81% Styrene/ 4% NMA/ 15% V502 | 71% Styrene/ 4% NMA/ 12.5% V103/ 12.5% V502 | 80% Styrene/ 4% NMA/ 1% Maleic/ 15% V502 |
| Post-added Crosslinker | 10% Glyoxal | 10% Glyoxal | 10% Glyoxal | 10% Glyoxal | 10% Glyoxal | 10% Glyoxal |
| Air Permeability $Ft^3$/sq. ft./min | 39.2 | 35.0 | 36.0 | 39.2 | 42.4 | 38.4 |
| Tensile (pli) | | | | | | |
| Dry | 33.0 | 35.6 | 29.4 | 29.5 | 27.9 | 27.2 |
| Wet | 15.0 | 20.4 | 15.3 | 13.3 | 17.4 | 18.0 |
| Stiffness (mg/in) | | | | | | |
| Dry | 4068 | 3756 | 5179 | 3434 | 3723 | 3200 |
| Wet | 674 | 1169 | 1443 | 1193 | 1305 | 1238 |
| 250° F. | 3212 | 2978 | 3356 | 3223 | 3434 | 2890 |

A4530 = Airflex ® 4530 ethylene-vinyl chloride-amide terpolymer - standard binder used to prepare air filter papers.
V103 = Airvol ® poly(vinyl alcohol) (DPn ~200; 98.5 mol % hydrolyzed)
V205 = Airvol ® poly(vinyl alcohol) (DPn ~500; 88 mol % hydrolyzed)
V502 = Airvol ® poly(vinyl alcohol) (DPn ~200; 88 mol % hydrolyzed)
V523 = Airvol ® poly(vinyl alcohol) (DPn ~1200; 88 mol % hydrolyzed)
MAMD = 1:1 mixture of acrylamide and N-methylolacrylamide
VAM = Vinyl acetate
VCl = Vinyl chloride
AAEM = acetoacetoxyethyl methacrylate
NMA = N-methylol acrylamide The data in Table 3 show that, compared to basepaper treated with a standard binder (sample 2) and basepaper treated with a binder in which grafted poly(vinyl alcohol) was 98.5 mol % hydrolyzed (samples 3–5), basepaper treated with graft emulsion copolymers of this invention (samples 6–14) exhibited excellent air permeability, dry tensile, dry stiffness, and stiffness after immersion in oil at 250° F. Samples 10–14 also showed good wet stiffness. Improvements in air permeability, tensile, and stiffness were achieved with graft emulsion copolymers in which the DPn of the poly(vinyl alcohol) varied from 200 to 1200 and the degree of hydrolysis was 88 mol % for at least 50% of the total poly(vinyl alcohol) in the graft copolymer. Contrary to the teachings of the prior art, the graft emulsion copolymers of this invention were stable and were effective as filter paper binders.

What is claimed is:

1. A high performance filter comprising a filter paper impregnated with a binder composition, said binder composition comprising an aqueous based poly(vinyl alcohol) graft emulsion copolymer, said poly(vinyl alcohol) graft emulsion copolymer prepared by graft polymerizing 10 to 90 wt % polyvinyl alcohol) with 10 to 90 wt % one or more ethylenically unsaturated monomer, and optionally, 0 to 10 wt % of a crosslinking monomer, in an aqueous medium, wherein at least 30 wt % of said polyvinyl alcohol) has a hydrolysis level of 70 to 97 mol %.

2. The high performance filter of claim 1, at least 30 wt % of said poly(vinyl alcohol) has a hydrolysis level of 85 to 95 mol % and a degree of polymerization ranging from 100 to 2000.

3. The high performance file of claim 1, wherein the grafted poly(vinyl alcohol) emulsion copolymer comprises:

20 to 50 wt % poly(vinyl alcohol), 50 to 80 wt % ethylenically unsaturated monomer units, and 2 to 6 wt % crosslinking monomer units.

4. The high performance filter of claim 3, wherein the crosslinking monomer is selected from the group consisting of acrylamide, methacrylamide, N-methylol-acrylamide, acetoacetoxyethyl methacrylate, maleic acid, an alkyl maleate ester, and a dialkyl maleate ester, and mixtures thereof, wherein alkyl is $C_1$ to $C_{12}$.

5. The high performance filter of claim 2, wherein the grafted poly(vinyl alcohol) emulsion copolymer comprises:

10 to 50 wt % poly(vinyl alcohol), 50 to 90 wt % ethylenically unsaturated monomer units, and optionally, 0 to 10 wt % crosslinking monomer units.

6. The high performance filter of claim 5, wherein the ethylenically unsaturated monomer is selected from the group consisting of vinyl acetate, styrene, vinyl chloride, an alkyl acrylate, an alkyl methacrylate, and mixtures thereof, wherein alkyl is $C_1$ to $C_{12}$.

7. The high performance filter of claim 6, wherein the ethylenically unsaturated monomer is selected from the group consisting of vinyl acetate, styrene, vinyl chloride, and mixtures thereof.

8. The high performance filter of claim 7, wherein the crosslinking monomer is selected from the group consisting of acrylamide, methacrylamide, N-methylol-acrylamide, acetoacetoxyethyl methacrylate, maleic acid, an alkyl maleate ester, and a dialkyl maleate ester, and mixtures thereof; wherein alkyl is $C_1$ to $C_{12}$.

9. The high performance filter of claim 2, wherein the grafted poly(vinyl alcohol) emulsion copolymer comprises:

15 to 50 wt % poly(vinyl alcohol), 50 to 85 wt % ethylenically unsaturated monomer units, and 2 to 6 wt % crosslinking monomer units.

10. The high performance filter of claim 9, wherein the crosslinking monomer is selected from the group consisting of acrylamide, methacrylamide, N-methylol-acrylamide, acetoacetoxyethyl methacrylate, maleic acid, a maleate ester, and a dialkyl maleate ester; and mixtures thereof, wherein alkyl is $C_1$ to $C_{12}$.

11. The high performance filter of claim 10, wherein the poly(vinyl alcohol) has a degree of polymerization ranging from 150 to 1500.

12. The high performance filter of claim 11, wherein the poly(vinyl alcohol) has a degree of hydrolysis ranging from 85 to 95 mol %.

* * * * *

UNITED STATES PATENT AND TRADEMARK OFFICE

CERTIFICATE OF CORRECTION

PATENT NO. : 6,390,305 B1 
DATED : May 21, 2002
INVENTOR(S) : John Joseph Rabasco, Ronald Bernal Jones, William Edward Lenney and George Davidowich It is certified that error appears in the above-identified patent and that said Letters Patent is hereby corrected as shown below:

Column 11,
Line 62, delete "polyvinyl alcohol)" and substitute therefor -- poly(vinyl alcohol) --.

Column 12,
Line 39, delete "file" and substitute therefor -- filter --.

Signed and Sealed this

Eighth Day of October, 2002

*Attest:*

*Attesting Officer*

JAMES E. ROGAN
*Director of the United States Patent and Trademark Office*